US005522148A

United States Patent [19]

Newman

[11] Patent Number: 5,522,148

[45] **Date of Patent: *Jun. 4, 1996**

[54] ROLLER FRAME ALIGNMENT BRACKET

[75] Inventor: Donald E. Newman, Wyncote, Pa.

[73] Assignee: Stretch Devices, Inc., Philadelphia, Pa.

[ * ] Notice: The term of this patent shall not extend beyond the expiration date of Pat. No. 5,377,422.

[21] Appl. No.: 347,757

[22] Filed: Dec. 1, 1994

Related U.S. Application Data

[63] Continuation-in-part of Ser. No. 143,791, Oct. 26, 1993, Pat. No. 5,377,422.

[51] Int. Cl.[6] ..... B41B 11/00; B41F 1/34

[52] U.S. Cl. ..... 33/620; 33/614; 38/102.1; 101/127.1; 160/378

[58] Field of Search ..... 33/614, 617, 620, 33/621; 38/102, 102.1, 102.4, 102.6, 102.91; 101/127.1, 128, 128.1, 415.1; 160/327, 328, 329, 378, 395

[56] References Cited

U.S. PATENT DOCUMENTS

| | | | |
|---|---|---|---|
| 1,072,908 | 9/1913 | Buda | 33/614 |
| 2,701,420 | 2/1955 | Monroy et al. | 33/614 |
| 3,098,431 | 7/1963 | Weaver | 33/614 |
| 3,492,900 | 2/1970 | Hill et al. | 33/614 |
| 4,226,181 | 10/1980 | Ericsson | 33/614 |
| 4,516,495 | 5/1985 | Ericsson | 33/614 |
| 4,738,909 | 4/1988 | Jennings . | |
| 4,972,773 | 11/1990 | Barlow | 101/128.1 |
| 5,094,160 | 3/1992 | Jennings . | |
| 5,127,176 | 7/1992 | Newman | 101/127.1 |
| 5,163,367 | 11/1992 | Newman | 101/127.1 |
| 5,315,929 | 5/1994 | Sundqvist | 33/621 |
| 5,377,422 | 1/1995 | Newman | 33/620 |

OTHER PUBLICATIONS

Literature from Diamond Chase Co. entitled "Diamond Pin System 1993".

*Primary Examiner*—William A. Cuchlinski, Jr.
*Assistant Examiner*—G. Bradley Bennett
*Attorney, Agent, or Firm*—Seidel Gonda Lavorgna & Monaco

[57] ABSTRACT

A registration/adapter apparatus for aligning a priming screen with an image platform. A screen tensioning and printing frame has four tensioning rollers coupled together by comer members. The comer members support the rollers for rotation about their longitudinal axis. Each roller has a channel for retaining an edge of a screen fabric. A means of locking each roller in a predetermined rotative position to hold the screen fabric at the desired tension is associated with each corner member. One of the rollers and its associated corner members has a pair of alignment means. The alignment means have a hole associated with one corner member and a slot associated with the other corner member. A registration member associated with the image platform has a pair of pins for aligning and being received by the hole and slot in the alignment means associated with the screen tensioning and printing frame. The pins received by the hole and slot ensure alignment of the screen tensioning printing frame with the image platform.

18 Claims, 9 Drawing Sheets

ROLLER FRAME ALIGNMENT BRACKET

This is a continuation-in-part application of application Ser. No. 08/143,791 which issued as U.S. Pat. No. 5,377,422, filed on Oct. 26, 1993.

FIELD OF THE INVENTION

This invention relates to a registration system for a screen printing roller frame and screen and particularly to a pair of corner members or adapters located on the roller frame, each having at least a slot or a hole for coupling with a plurality of pins on a registration bracket.

BACKGROUND OF THE INVENTION

In the majority of screen printing operations, more than one color is used to create the desired image. The use of more than one color results in using several screens, one for each color, wherein each screen has the associated image for that color. It is therefore necessary to ensure that the images from each screen align properly so that the associated colors align properly. This is typically done by ensuring that the screen is properly aligned in the frame and aligning the frame to a platform which receives the article that is to receive the image.

One convention is to attach the rigid frame to a screen holder, wherein the screen holder has a stationary bar and a moveable bar that pivots up and down relative to the stationary bar. At the end of that moveable bar is located a U-shaped print head or frame holder channel. The U-shaped channel has a pair of operating screws with swivel heads that rotate to engage the frame. The frame moves with the moveable bar downward in proximity with the article and the platform to align the image on the screen with the article so that the image may be transferred to the article. It is a trial and error process to align the frame in the U-shaped channel to achieve proper alignment.

Tensioning frames replace the rectangular sides of the frame with tensioning rollers. The curved rollers create a difficult surface to secure the screen holder for proper alignment. One design to overcome this problem is a tensioning frame that has three tensioning rollers and a square side which is not adjustable. Furthermore, to achieve the desired result from high tension screens, the frame must be tensioned periodically. The use of one square non-rotatable side does not achieve all the benefits of tour tension sides.

It is desired to have a registration means that allows easy accurate alignment and in addition allows several different frames to be received without changes to a registration bar.

SUMMARY OF THE INVENTION

The present invention relates to a registration/adapter apparatus for aligning a printing screen with an image platform. A screen tensioning and printing frame has four tensioning rollers coupled together by corner members. The corner members support the rollers for rotation about their longitudinal axis. Each roller has a channel for retaining an edge of a screen fabric. A means of locking each roller in a predetermined rotative position to hold the screen fabric at the desired tension is associated with each corner member. One of the rollers has a pair of alignment means. A registration member is associated with the image platform. The alignment means and registration member has a coupling means for removably linking the printing frame to the registration member. The coupling means has a pair of pins being received by a hole and a slot for aligning the printing screen to the image platform.

In a preferred embodiment, a bolt associated with each corner member locks each roller in a predetermined rotative position to hold the screen fabric at the desired tension. One of the rollers has a pair of associated adapters interposed between the head of the bolt and the associated corner member. The adapter has a hole on one surface and a slot on the opposite surface. A registration member associated with the image platform has a pair of pins for aligning and being received by the hole and slot in the adapter associated with the screen tensioning and printing frame. The pins received by the hole and slot ensure alignment of the screen tensioning printing frame with the image platform.

Further objects, features and advantages of the present invention will become more apparent to those skilled in the art as the nature of the invention is better understood from the accompanying drawings and detailed descriptions.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
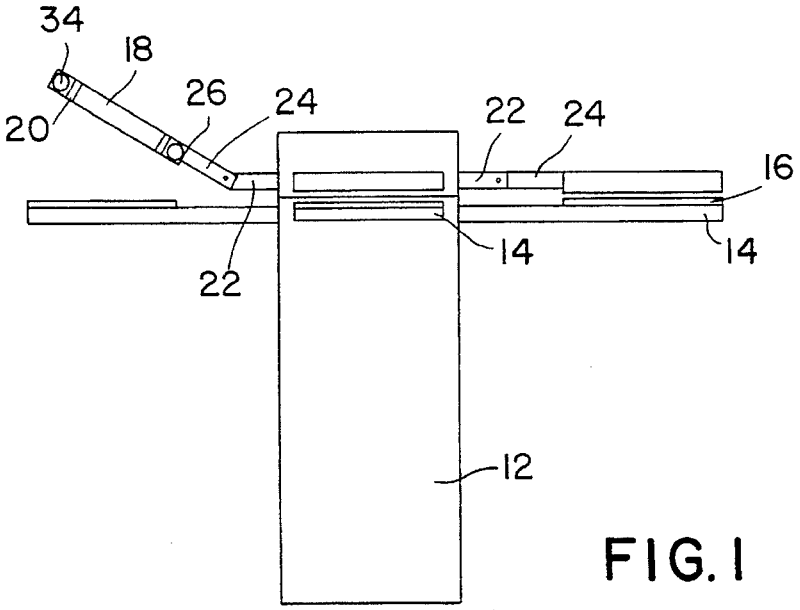
FIG. 1 is a schematic of a screen printer having an image platform and a roller mesh frame screen aligned by a registration/adapter apparatus of the present invention.

Referring to the drawings in detail, where like numerals indicate like elements, there is illustrated a device in accordance with the present invention designated generally as 10.

Referring to FIG. 1, a printer station 12 has a platform 14, such as a pallet, for receiving an article 16, such as a shirt or a poster, to place the image on. A roller frame 18 has a screen 20 which contains an image which is to be transferred to the article 16. The printer station 12 has a stationary registration bar 22 and a moveable registration bar 24 pivotable to the moveable registration bar 24 relative to the stationary registration bar 22. The moveable registration bar 24 has at an end opposite the stationary registration bar 22, a print head which in this embodiment is a registration apparatus 26 having a plate 28 and a "U" shaped channel 30.

The registration apparatus 26 is a part of registration/adapter apparatus 10 of this embodiment which connects the roller frame 18 to the moveable registration bar 24, such that as the moveable registration bar 24 is moved downward, the image on the screen 20 is properly aligned with the article on the platform 14. Typically the stationary registration bar 22 and moveable registration bar 24 rotate relative to the platform 14, such that a single roller frame 18 aligns with several platforms 14 upon rotation.

Figure 2:
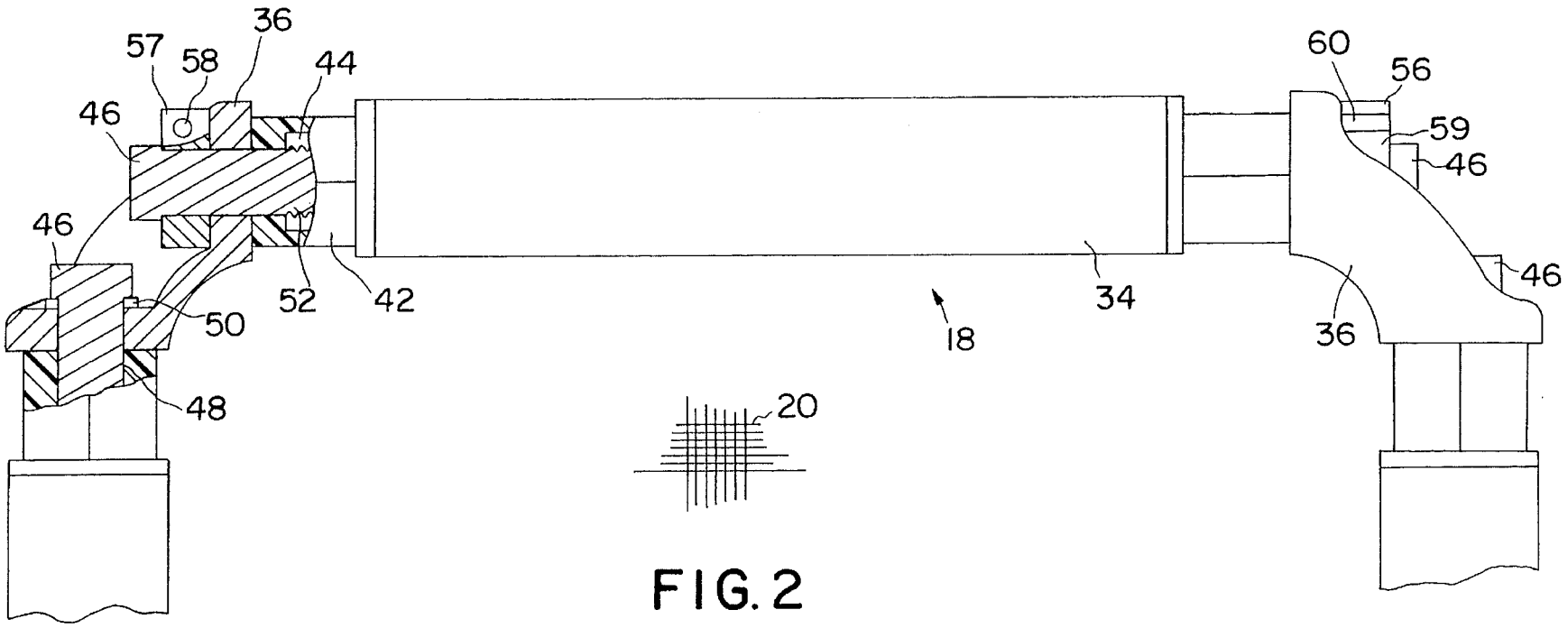
FIG. 2 is a broken out portion of the roller frame having an adapter.

Referring to FIG. 2, the roller frame 18 has four rollers 34 (only three shown) and four corner members 36 (only two shown). Each roller 34 extends between two corner members 36 and has a pair of end plugs 42. Each end plug 42 contains a nut 44. A bolt 46 having a shaft 48, extends through a washer 50 and the corner member 36 with a threaded portion 52 received by the nut 44. The screen 20 (only a portion is shown) is secured to the rollers 34, and tension in the screen 20 is created by rotation of the rollers 34. The tension is maintained by locking the rollers 34 at a predetermined rotated position by securing the bolt 46 to the nut 44. U.S. Pat. No. 5,127,176 discloses a similar construction of the roller frame 18 and is herein incorporated by reference.

A pair of washers 50 associated with one of the rollers 34 are replaced by a pair of registration adapters 56. The registration adapters 56 are identical and preferably made of hardened stainless steel or other suitable material. The registration adapters 56 are mounted adjacent to the corner members 36 so that a surface 57 having a hole 58 is positioned downward on one of the registration adapters 56 and a surface 59 having a slot 60 is positioned downward on the other registration adapter 56.

Figure 3:
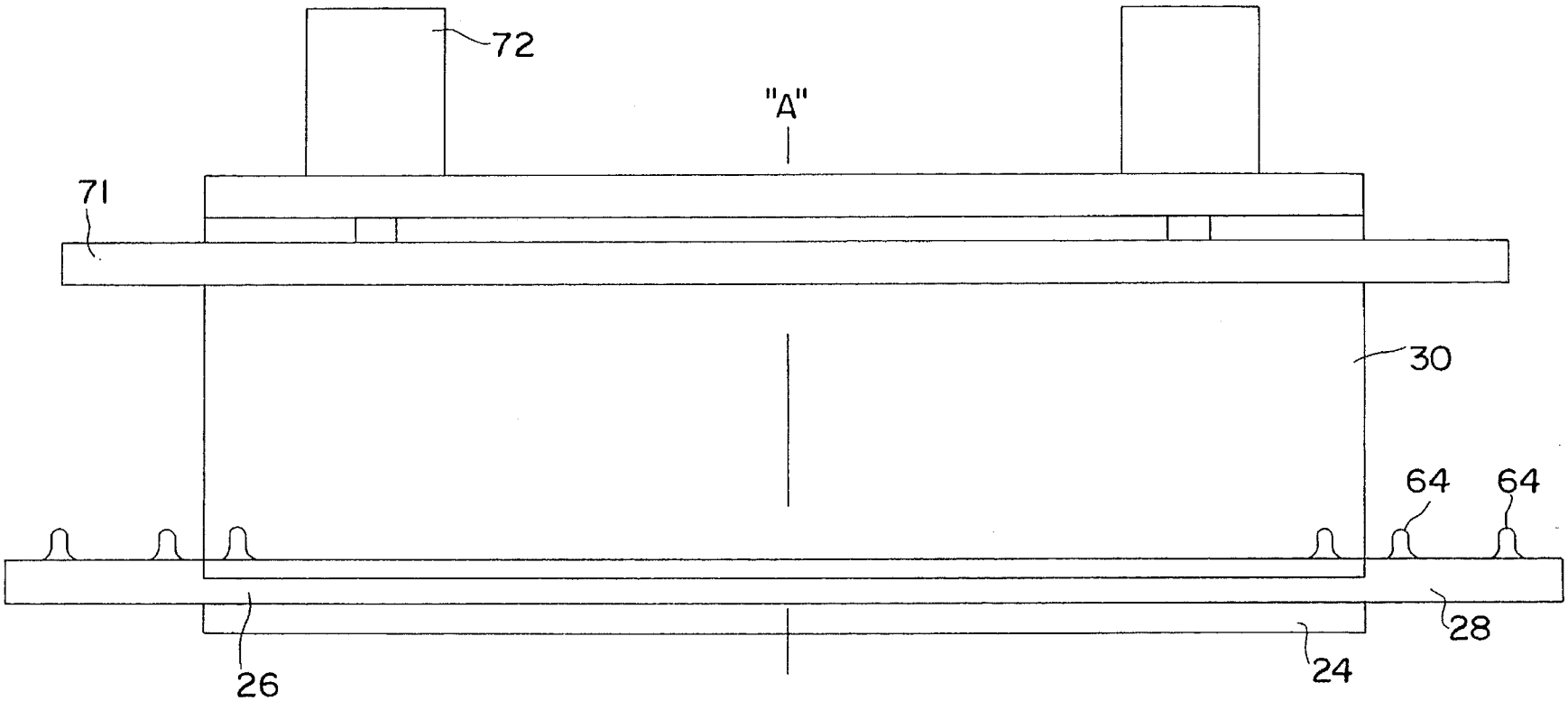
FIG. 3 is side view of the registration bar.

Referring to FIG. 3, the "U" shaped channel 30 and the plate 28 of the registration apparatus 26 are secured to each other. The plate 28 is secured to the moveable registration bar 24 and has a plurality of pins 64. The pins 64 are symmetric about a center line "A" and positioned for varying size roller frames 18. In addition, pins 64 have a tapered shape to ease alignment.

Figure 4:
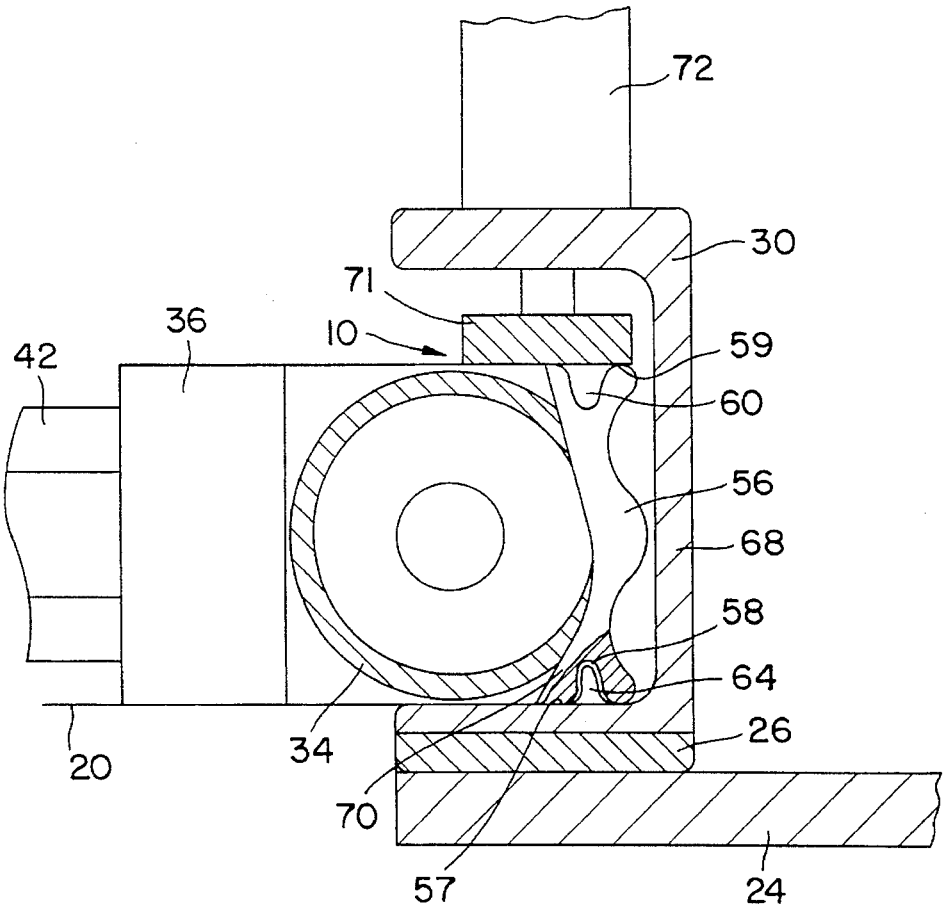
FIG. 4 is a section view of the registration bar and the roller frame with a portion of the roller and corner member broken away.

Referring to FIG. 4, the hole 58 of the registration adapter 56 of the roller frame 18 receives one of the pins 64 located in the plate 28 to position the roller frame 18 relative to the registration apparatus 26 of the moveable registration bar 24. The slot 60 in the other registration adapter 56 of the roller frame 18 assist in the alignment by preventing rotation of the rollers 34 about the pins 64/hole 58 connection. The pins 64 in the moveable registration bar 24 are positioned in proximity to a base 68 of the "U" shaped channel 30 so that those pins 64 which do not align with the hole 58 and slot 60 in the registration adapter 56, do not interfere with roller frame 18, more specifically the roller 34. The pins 64 are received in a gap 70 to be defined by the base 68 and the rollers 34, and do not project into engagement with the roller 34. The hole 58 and the slot 60 are tapered similarly to the pins 64 to ease insertion of the pins 64 and ensure alignment.

In operation, the screen 20 is attached properly to the roller frame 18. The bolts 46 are loosened and the screen 20 is tensioned by rotation of the rollers 34 via rotation of the end plugs 42. The bolts 46 are then re-tightened. The roller 34 associated with the adapters 56 is tensioned similarly to the other rollers 34.

After the screen 20 is tensioned properly on the roller frame 18, a stencil containing the image is placed on a set board (not shown). The set board has a series of horizontal lines including a center line and a series of vertical lines for alignment of the stencil. In addition, the set board has pins, similar to the pins 64 of the plate 28 of the registration apparatus 26. After the stencil is secured to the set board by any of the numerous ways, including vacuum, the roller frame 18 is placed on the set board with the hole 58 and slot 60 receiving the pins on the set board. The stencil is then secured to the frame and therefore properly aligned with the roller frame 18. An alternative to the horizontal and vertical lines on the set board is an additional set of pins that receive holes located in the stencil to ensure alignment of the stencil with the roller frame 18.

Referring to FIG. 4, the roller frame 18 with the adapters 56 are positioned in the "U" shaped channel 30 of the registration apparatus 26. The adapters 56 are lowered onto the pins 64, wherein one of the pins 64 is received by the hole 58 and another pin 64, the pin symmetrically positioned relevant to the center line "A", by the slot 60. The slot 60 allows for slight variation in roller frame 18 size. The pins 64 not received by the adapters 56 are either located outside of the roller frame 18 or are positioned in the gap 70 created by the roller 34.

The roller frame 18 is additionally secured to the registration apparatus 26 by a bar 71 which is lowered into engagement with the corner member 36 by a pair of air cylinders 72 therein preventing the roller frame 18 from moving off the pins 64.

Referring to FIG. 1, with the roller frame 18 properly aligned, the roller frame 18 moves down with the moveable registration bar 24 to allow the transfer of the image from the screen 20 to the article 16. The moveable registration bar 24, with the print head having the registration apparatus 26, moves upward to allow either another article 16 to be placed on the platform 14 or to rotate the registration bars 24 and registration apparatus 26 on the printer 12 relative to the platform 14.

Figure 5:
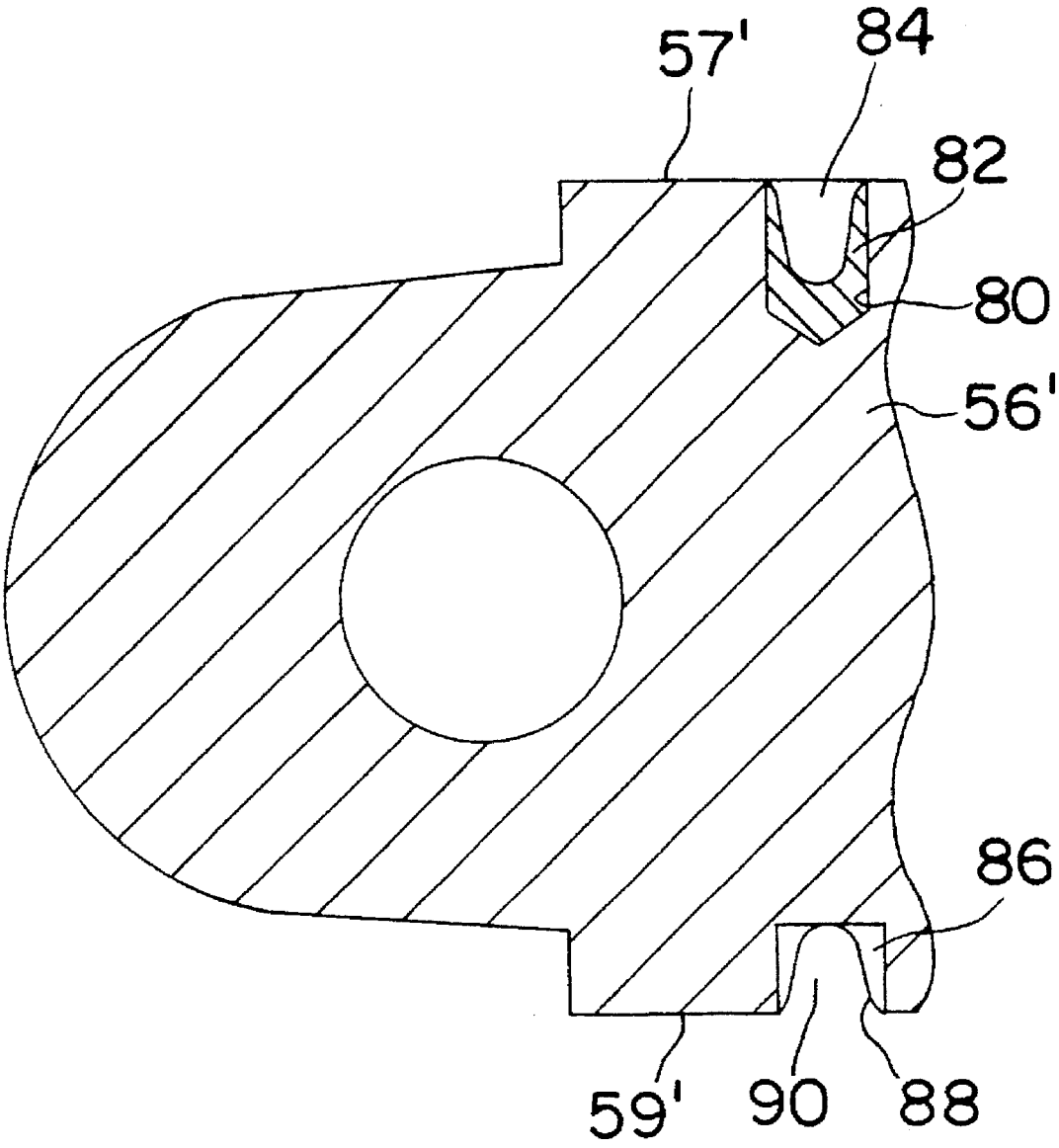
FIG. 5 is an enlarged section view of the adapter and the pin showing an alternative embodiment of the adapter.

Referring to FIG. 5, an alternative embodiment has a registration adapter 56' made from aluminum. The registration adapter 56' has a hole 80 on the surface 57' for receiving a steel bushing 82. The steel bushing 82 has a hole 84 with a tapered shape for receiving the pin 64. The registration adapter 56' has a slot 86 on the surface 59' which receives a strip 88 of spring steel. The strip 88 forms a slot 90 for receiving a pin 64. While the strip 88 is shown such that it opens downward toward surface 59', it is recognized that the strip 88 of spring steel could be installed so it opened on one of the ends of the slot 86 and closed at the other ends. In either position, the slot 86 is open on the surface 59' to receive the pin 64. The registration adapter 56' is mounted similarly to the previous embodiment in that the two registration adapters 56' used with the roller frame 18 are identical and one is positioned so that the hole 58 projects downward and the other is positioned so that the slot 60 is positioned downward.

Figure 6:
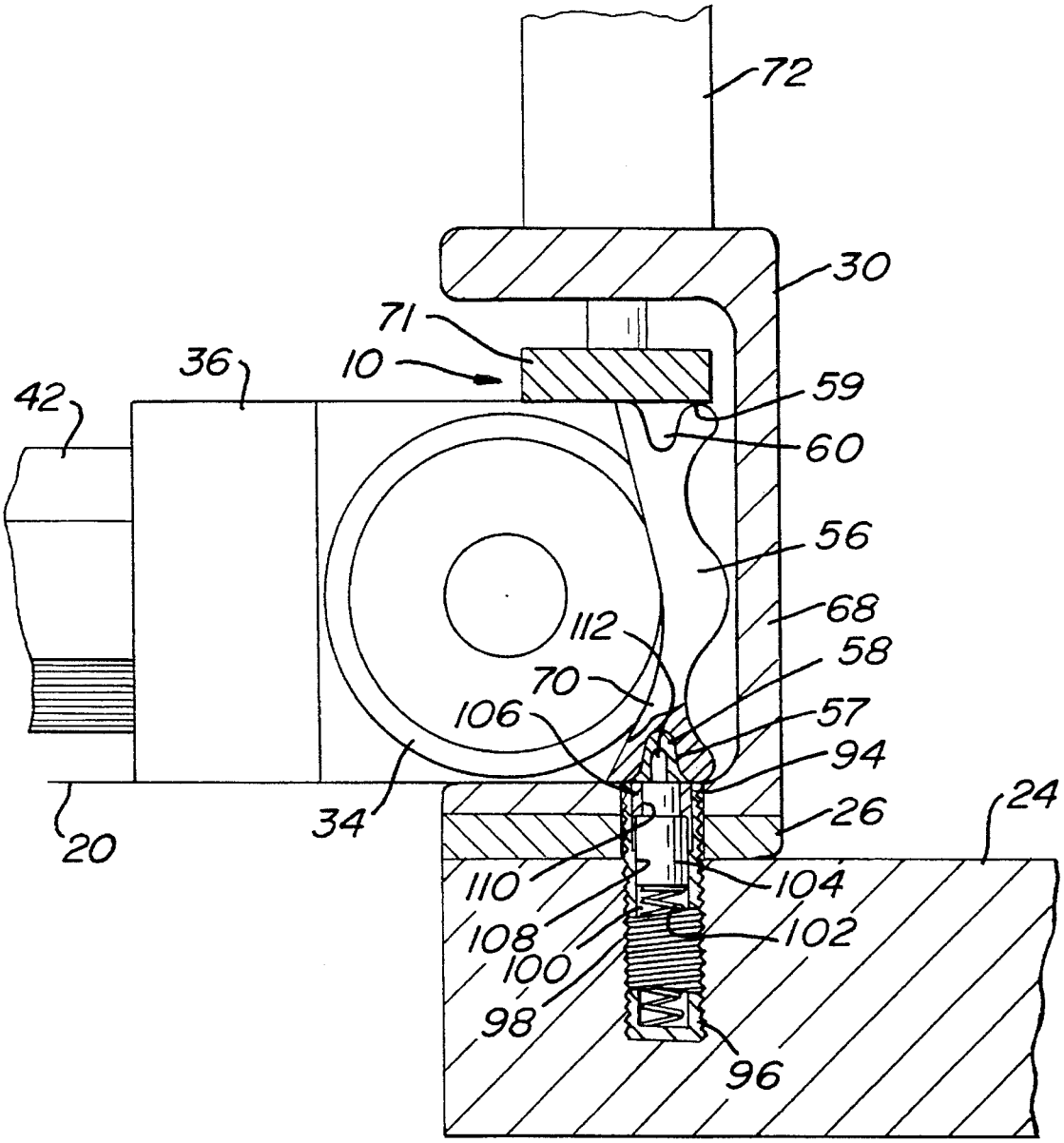
FIG. 6 is a section view of an alternative registration bar having a spring pin and the roller frame with a portion of the roller and corner member broken away.

Referring to FIG. 6, an alternative embodiment of the registration apparatus 26 has a spring pin 94 in place of the rigid tapered pin 64. The spring pin 94 has an outer shaft 96 which is threaded on the outer diameter and received by a hole 98 in the moveable registration bar 24 and the registration apparatus 26. The outer shaft 96 has a bore 100 that extends upward from in proximity to the bottom of the outer shaft 96. The bore 100 receives a compression spring 102, a moveable pin 104 and a bushing 106.

The moveable pin 104 has three stepped faces, a larger face 108, a middle face 110 and a smaller face 112. The larger face 108 is sized to slideably fit in the bore 100. The middle face 110 is sized to slideably engage the bushing 106, therein ensuring alignment of the moveable pin 104. This alignment is also ensured by the larger face 108 sliding within the bore 100 as it moves. A shoulder 114, between the larger face 108 and the middle face 110, engages with bore 100 to limit the upward movement. The smaller face or pin 112 is adapted to be received by the hole 58 or slot 60 of the registration adapter 56.

The adapters 56 are lowered onto the spring pins 94, where one of the spring pins 94 is received by the hole 58 and the other spring pin 94, the pin symmetrically positioned relevant to the center line "A" as shown in FIG. 3, by the slot 60. As in the first embodiment, the slot 60 allows for slight variations in roller frame 18 size. In contrast to the first embodiment, the spring pins 94 not received by the registration adapter 56 can either be located outside the roller frame 18, or are positioned in the gap 70 created by the roller 34 or are depressed flush with the surface of the U-shaped channel 30.

Figure 7:
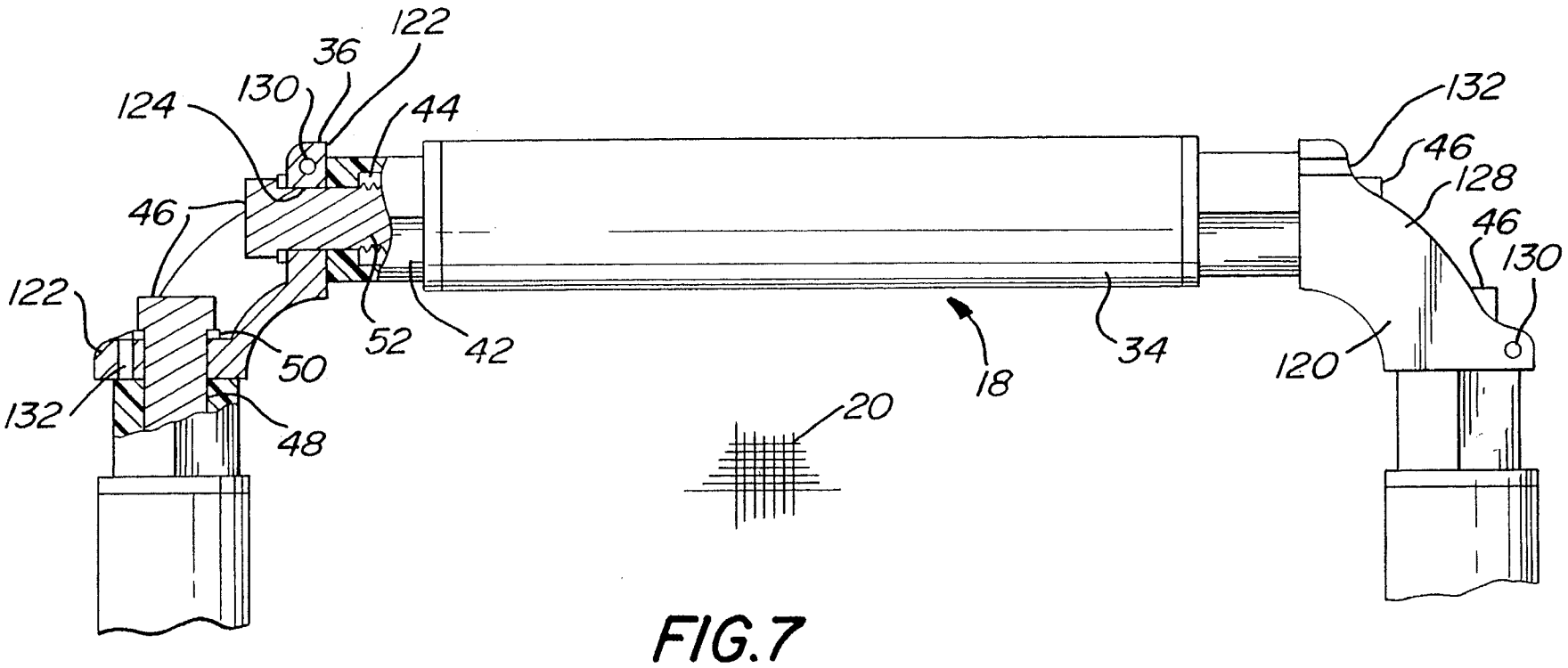
FIG. 7 is a broken out portion of an alternative embodiment of the roller frame having a corner member including a hole and a slot for alignment with a plurality of registration pins.
Figure 8:
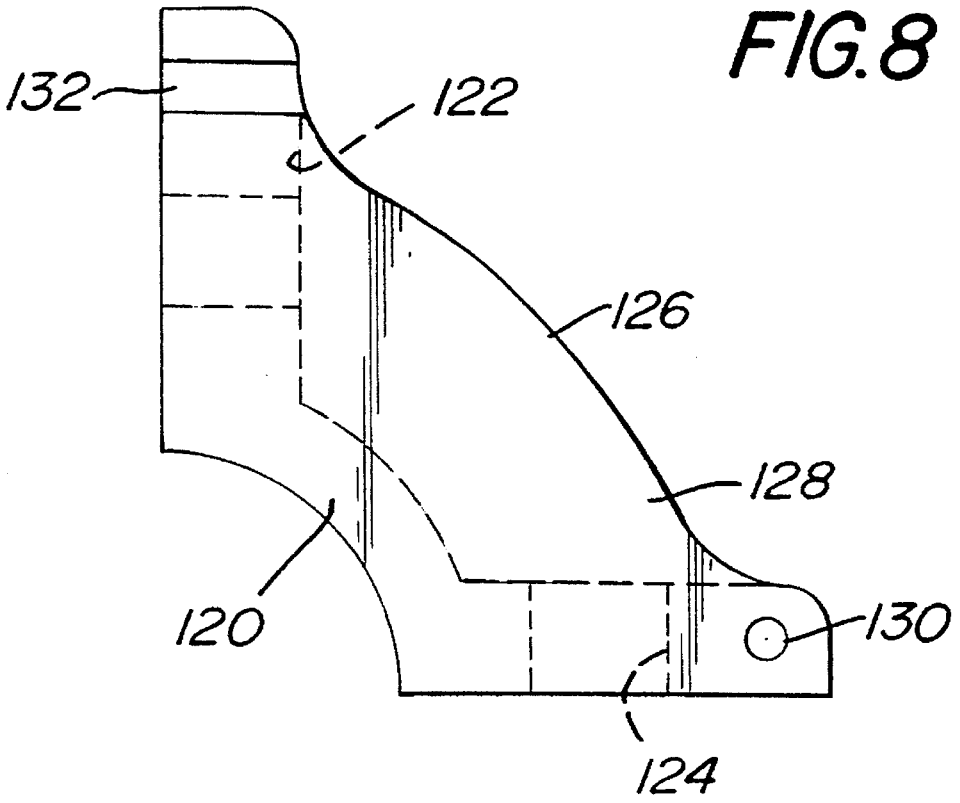
FIG. 8 is a top view of the corner member of the alternative embodiment of FIG. 7.

Referring to FIGS. 7 and 8, an alternative embodiment shown wherein the roller frame 18 has four rollers 34 (only three shown) and four corner members 120. The corner members 120 have a pair of legs 122. Each leg 122 has a hole 124 through which the bolt 46 extends. The corner members 120 have a pair of stiffening ribs 126 that extend between the legs 122. Each stiffening rib 126 has an outer surface 128.

In contrast to the first embodiment, the washers 50 associated with one of the rollers 34 are not replaced by a pair of registration adapters 56. Rather, the surface 128 of the corner members 120 has a hole 130 associated with one of its legs 122 and a slot 132 associated with the other leg 122. The other surface 128 of the corner member 120 is similarly constructed. The hole 130 and the slot 132 associated with one of the rollers 34 receives the pin 64 so as to have the roller frame 18 properly aligned or registered, similar to the first embodiment.

Figure 9:
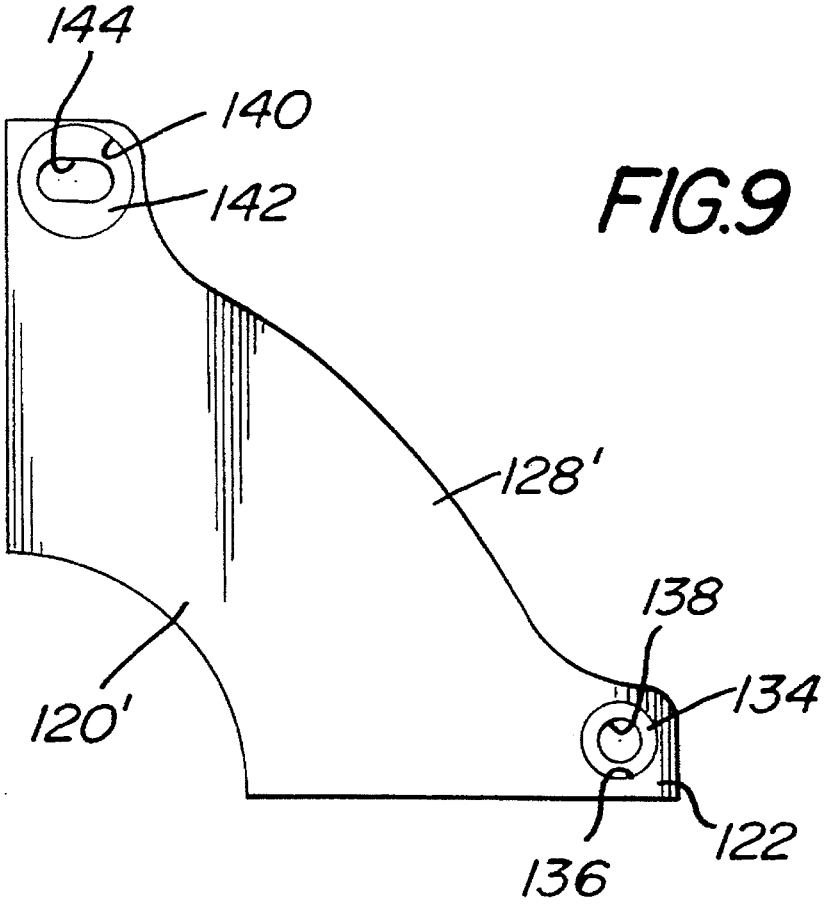
FIG. 9 is a top view of an alternative corner member.

Referring to FIG. 9, an alternative embodiment of the corner member 120' where the corner member 120' is shown. In situations where the corner member 120' is made of aluminum, woven glass or other lightweight material, it might be desirable to add an insert such as a steel bushing 134 to ensure proper registration. The corner member 120' has a hole 136 on the surface 128' in proximity to one of the legs 122 for receiving the steel bushing 134. The steel bushing 134 has a hole 138 for receiving the pin 64. It is recognized that the hole 138 could be straight, tapered or a portion tapered. The corner member 120' has a larger hole 140 on the surface 128' in proximity to the other leg 122 for receiving a second steel bushing 142. The second steel bushing 142 has a slot shaped hole 144 having a pair of parallel sides and which acts similarly to the slot 60. It is recognized that the corner member 120' could likewise have a slot which receives a strip of spring steel as shown in FIG. 5 in association with a registration adapter 56'.

Figure 10:
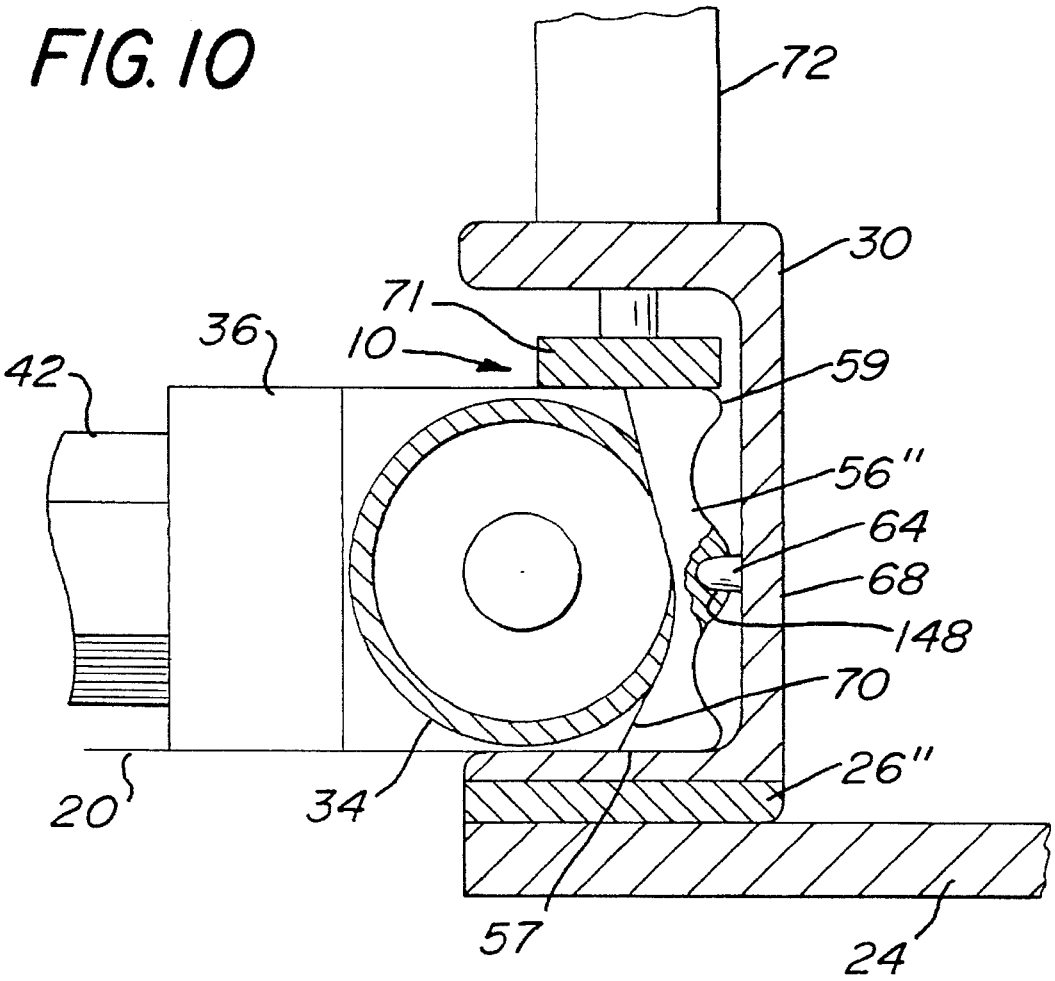
FIG. 10 is a section view of an alternative registration bar and the roller frame with a portion of the roller and corner member broken away.
Figure 11:
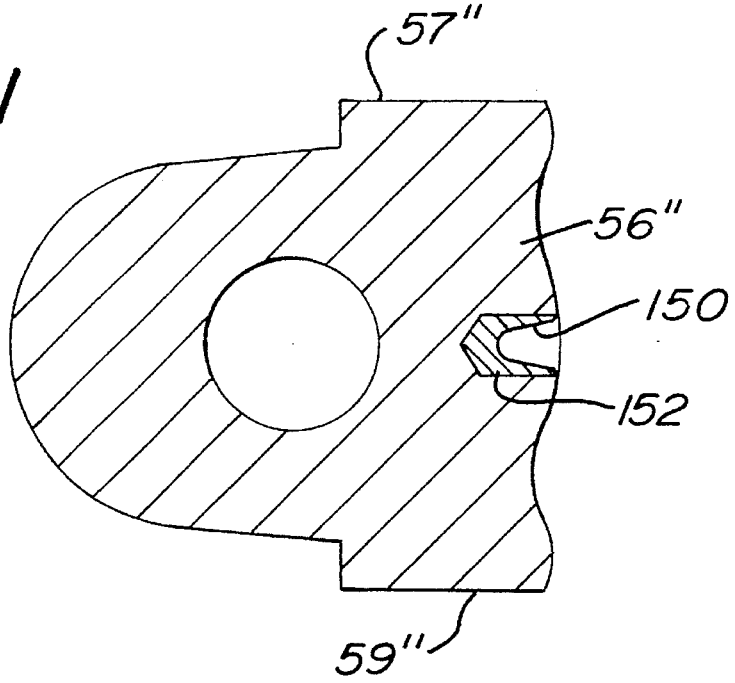
FIG. 11 is an enlarged section view of another adapter which works in conjunction with the adapter shown in FIG. 10.

Referring to FIGS. 10 and 11, an alternative registration adapter 56" and registration apparatus 26" are shown. The registration adapter 56" is preferably made of hardened stainless steel or other suitable material. The adapters 56" have a hole 148 positioned to open on a vertical plane to receive a pin 64 which projects horizontally from the "U" shaped channel 30, as seen in FIG. 10. A second style registration adapter 56" has a slot 150, as seen in FIG. 11, to receive a second pin 64, not shown, which projects horizontally from the "U" shaped channel 30. The slot is shown formed by installing a bushing 152 into a hole.

Referring to FIG. 10, the hole 148 of the registration adapter 56" of the roller frame 18 receives one of the pins 64 located in the plate 28 to position the roller frame 18 relative to the registration apparatus 26" of the moveable registration bar 24. The slot 150 in the other style registration adapter 56" of the roller frame 18 assist in the alignment by preventing rotation of the roller frame 34 about the pin 64/hole 58 connection. However, the pin 64/hole 58 connection is designed so that the surface 57 of the adapter member 56" is in proximity to the "U" shaped channel 30.

The pins 64 could be spring pin 94 as shown in FIG. 6 so that those pins 94 which do not align with the hole 148 and slot 150 in the registration adapter 56", do not interfere with roller frame 18. In addition, this style registration adapter 56" would typically be used with a print head that had a pair of "U" or "C" shaped channels that move relative to each other towards and away from each other. One of the "U" shaped channels 30 is rigidly mounted and the other channel 30 is moved by a pair of air cylinders relative to the first channel 30. In the alternative, both channels 30 are capable of moving towards each other by use of air cylinders.

Figure 12:
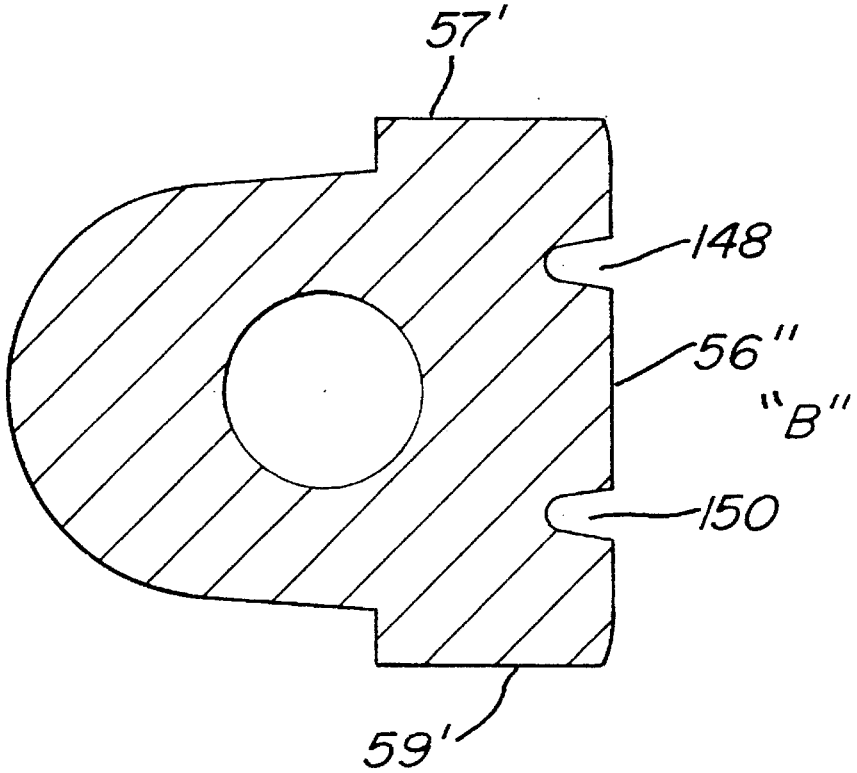
FIG. 12 is an enlarged section view of alternative embodiment of an adapter.

In the alternative as seen in FIG. 12, the hole 148 and the slot 150 in the adapter 56" are both located symmetrical of the center line "B". Therefore similar to the first embodiment, the pins 64 which do not align with the hole 148 or slot 150 are received in the gap 70 to be defined by the base 68 and the roller 34, as shown in FIG. 4, and do not project into engagement with the roller 34.

It is also recognized that a hole or slot could likewise be added to the vertical face of the corner member as shown with the adapter 56 in FIGS. 10–12.

It is recognized that while the registration pins have been shown in association with the U-shaped channel 30 of the print head or screen holder of registration apparatus 26, a bar containing alignment pins 64 could be mounted on other locations of the printer station 12 such as on the platform 14 where the substrate to be printed on will reside, such as a pallet for a shirt. The pins 64 would be used similar to as above for aligning the roller frame 18 prior to being secured by the registration apparatus 26. The registration apparatus 26 in this case would not contain pins. In addition, it is recognized that a roller frame 18 could have more than two pins used, such as if a pair of "U" shaped channels 30 are used. Furthermore while the printer station 12 shown is a manual machine, it is recognized that a similar apparatus would work with an automatic machine having a print head.

Moreover, while the registration system has been described in association with a machine having a pallet for receiving the substrate to be printed on, it is recognized that this registration system could be used with other screen printing systems, such as with graphic machines having vacuum beds.

The present invention may be embodied in other specific forms without departing from the spirit or essential attributes thereof and, accordingly, reference should be made to the appended claims, rather than to the foregoing specification, as indicating the scope of the invention. For example, instead of a bolt 46 having a threaded portion 52 received by a nut 44 in an end plug, a threaded shaft could extend from the roller and receive a nut located outboard of the corner member and the adapter, if present.

I claim:

1. A registration apparatus for a printing screen and an image platform, the apparatus comprising:

a screen tensioning and printing frame;

the frame having a plurality of rollers coupled together by corner members which support the rollers for rotation of each about its longitudinal axis, each roller having a means for retaining an edge portion of a screen fabric;

means associated with each corner member for locking each roller in a predetermined rotative position so that a desired tension may be applied to the screen fabric;

a pair of adapters, each adapter engaging the associated corner member;

a registration member associated with the image platform; and the adapters and the registration member having coupling means for removably linking the printing frame to the registration member, the coupling means having a pair of pins received by a hole and a slot.

2. A registration apparatus for a printing screen and an image platform, the apparatus comprising:

a screen tensioning and printing frame;

the frame having a plurality of rollers coupled together by corner members which support the rollers for rotation of each about its longitudinal axis, each roller having a means for retaining an edge portion of a screen fabric;

means associated with each corner member for locking each roller in a predetermined rotative position so that a desired tension may be applied to the screen fabric;

the means for locking one of the rollers having a pair of shafts extending through the associated corner member into engagement with the roller;

affixing means for affixing in connection with the roller, the shaft to the corner member;

a pair of adapters interposed between the affixing means and the associated corner member;

a registration member associated with the image platform; and the adapters and the registration member having coupling means for removably linking the priming frame to the registration member, the coupling means having a pair of pins received by a hole and a slot.

3. A registration apparatus for a printing screen and an image platform of claim 2, wherein the registration member has the pair of pins and one of the adapters has at least the slot and the other adapter has at least the hole.

4. A registration apparatus for a printing screen and an image platform, the apparatus comprising:

a screen tensioning and printing frame;

the frame having a plurality of rollers coupled together by corner members which support the rollers for rotation of each roller about its longitudinal axis, each roller having a means for retaining an edge portion of a screen fabric;

means associated with each corner member for locking each roller in a predetermined rotative position so that a desired tension may be applied to the screen fabric;

an alignment means associated with the corner members of one of the rollers;

a registration member associated with the image platform, and the alignment means and the registration member having coupling means for removably linking the printing frame to the registration member, the coupling means having a pair of pins received by a hole and a slot.

5. A registration apparatus for a printing screen and an image platform of claim 4, wherein the pins are located on the registration member and the pins are adapted for translation towards and away from the frame.

6. A registration apparatus for a printing screen and an image platform of claim 5, wherein the pin has a moveable shaft slideably position in a bore, the pin has a compression spring for biasing the moveable shaft towards the frame.

7. A registration apparatus for a priming screen and an image platform of claim 6, wherein the pin has a bushing located in the bore for limiting the movement towards the frame of the moveable shaft, and the moveable shaft has at least three faces, the middle face slideably engaging the bushing.

8. A registration apparatus for a printing screen and an image platform of claim 4, wherein the alignment means is the corner members associated with the one of rollers.

9. A registration apparatus for a printing screen and an image platform of claim 8, wherein the registration member has the pair of pins and one of the corner members having the hole for alignment with one of the pins and the other corner member having the slot for alignment with the other pin.

10. A registration apparatus for a printing screen and an image platform, the apparatus comprising:

a screen tensioning and printing frame;

the frame having a plurality of rollers coupled together by corners which support the rollers for rotation of each of the rollers about its longitudinal axis, each roller having a means for retaining an edge portion of a screen fabric;

a locking device associated with each corner member for locking each roller in a predetermined rotative position so that a desired tension may be applied to the screen fabric;

at least the corners associated with one of the rollers having an alignment apparatus;

a registration member associated with the image platform, and the alignment apparatus of each of the corners and the registration member having coupling means for removably linking the printing frame to the registration member, the coupling means having a pair of pins received by a pair of openings.

11. A registration apparatus for a printing screen and an image platform of claim 10, wherein the alignment apparatus of each of the corners is an adapter associated with the corner and interposed between the corner and a portion of the locking device associated with each comer member for locking each roller.

12. A registration apparatus for a printing screen and an image platform of claim 10, wherein the alignment means is the corner associated with the one of the rollers.

13. In a registration apparatus for a printing screen and an image platform comprising:

a screen tensioning and priming frame; the frame having a plurality of rollers coupled together by corners which support the rollers for rotation of each of the rollers about its longitudinal axis, each roller having a means for retaining an edge portion of a screen fabric; a locking device associated with each comer member for locking each roller in a predetermined rotative position so that a desired tension may be applied to the screen fabric; and a registration member associated with the image platform, the improvement comprising:

at least the corners associated with one of the rollers having an alignment apparatus; the alignment apparatus of each of the corners and the registration member having coupling means for removably linking the printing frame to the registration member, the coupling means having a pair of pins received by a hole and a slot.

14. A registration apparatus for a printing screen and an image platform of claim 13, wherein the alignment apparatus of the corner is a hole in the corner adapted to receive one of the pins.

15. A registration apparatus for a printing screen and an image platform of claim 14, wherein the hole in one of the corners is a slot.

16. A registration apparatus for a printing screen and an image platform, the apparatus comprising:

a screen tensioning and printing frame;

the frame having a plurality of rollers coupled together by comers which support the rollers for rotation of each of the rollers about its longitudinal axis, each roller having a means for retaining an edge portion of a screen fabric;

a locking device associated with each corner member for locking each roller in a predetermined rotative position so that a desired tension may be applied to the screen fabric;

at least the corners associated with one of the rollers having an alignment apparatus, the alignment apparatus adapted for allowing non-interferential tensioning of the screen fabric by rotation of the roller;

a registration member associated with the image platform; and the alignment apparatus of each of the corners and the registration member having coupling means for removably linking the priming frame to the registration member.

17. A registration apparatus for a printing screen and an image platform of claim 16, wherein the alignment apparatus of each of the comers is an adapter associated with the corner and interposed between the corner and a portion of the locking device associated with each corner member for locking each roller.

18. A registration apparatus for a priming screen and an image platform of claim 16, wherein the alignment means is the corner associated with the one of the rollers.

* * * * *